US007406962B1

(12) United States Patent
Chen

(10) Patent No.: US 7,406,962 B1
(45) Date of Patent: Aug. 5, 2008

(54) PLATFORM MINUTE ADJUSTMENT, EXPANSION AND WATER COLLECTION DEVICES

(76) Inventor: Yuehting Chen, P.O. Box 697, Fongyuan City 420, Taichung County (TW) 420

( * ) Notice: Subject to any disclaimer, the term of this patent is extended or adjusted under 35 U.S.C. 154(b) by 0 days.

(21) Appl. No.: 11/707,927

(22) Filed: Feb. 20, 2007

(30) Foreign Application Priority Data

Jan. 19, 2007 (TW) ..... 96201052 U

(51) Int. Cl.
*B28D 1/04* (2006.01)

(52) U.S. Cl. ..... 125/13.01; 125/13.03; 125/14; 125/35; 451/450

(58) Field of Classification Search ..... 125/13.01, 125/13.03, 14, 17, 16.01, 16.03, 35, 23.02, 125/11.22; 83/485, 486.1, 487; 144/286.1, 144/285, 287; 451/340, 449, 450, 411, 360
See application file for complete search history.

(56) References Cited

U.S. PATENT DOCUMENTS 4,428,159 A * 1/1984 Sigetich et al. ..... 451/213
6,080,041 A * 6/2000 Greenland ..... 451/11
6,152,127 A * 11/2000 Fuhrman et al. ..... 125/35
6,263,866 B1 * 7/2001 Tsao ..... 125/13.01
6,439,218 B1 * 8/2002 Hulett ..... 125/13.01
6,752,140 B1 * 6/2004 Fuhrman et al. ..... 125/13.03
7,028,683 B1 * 4/2006 Chen ..... 125/13.03
2002/0124841 A1 * 9/2002 O'Banion et al. ..... 125/13.01
2005/0051015 A1 * 3/2005 Zhang ..... 83/651
2007/0144509 A1 * 6/2007 Li ..... 125/13.01

* cited by examiner

*Primary Examiner*—Eileen P. Morgan

(57) ABSTRACT

A platform minute adjustment, expansion and collection device for a stone cutter includes a water tank supported by a pair of racks, a pair of guide rods spacedly bridged on the racks, a first water collection plate and a second water collection plate, both of which are slantly disposed to a front rack, a platform having a pair of rotors on the lower side thereof and slidably engaged on the inner sides of the guide rod. The platform has a pair of expansion plates for enlarging its size and for cutting a large-sized working piece, and two minute adjusting devices mounted on the tops of the racks for displacing the platform slightly, such that the sawdust may be stopped scattering all over the working place.

1 Claim, 8 Drawing Sheets

PLATFORM MINUTE ADJUSTMENT, EXPANSION AND WATER COLLECTION DEVICES

BACKGROUND OF THE INVENTION

The present invention relates to a cutting machine, and more particularly to a platform minute adjustment, expansion and water collection device for a stone cutter in which the platform has two expansion portions and at least one water collection member.

Conventionally, the working area of a portable stone cutter is limited. It is troublesome for the operator to cutter large sized working pieces. Besides, during cutting the working pieces made of stone, metal or wood, the sawdust rises up and splashes to the front side of the platform although a water tank disposed under the platform, accordingly the operator breathes the sawdust, seriously affecting lungs.

Further, the conventional stone cutter has a positioning device only including a saw blade for moving upward and downward but not including an adjustable displacement member, causing precision errors.

SUMMARY OF THE PRESENT INVENTION

The primary object of the present invention is to provide a platform minute adjustment, expansion and water collection devices for a stone cutter that may prevent the sawdust from being scattered all over the working place.

Another object of the present invention is to provide a platform minute adjustment, expansion and water collection device for a stone cutter that may reduce the water foam and sawdust effectively.

Still another object of the present invention is to provide a platform minute adjustment, expansion and water collection device for a stone cutter which has an expansion platform by which the working pieces may be positioned in an accurate position so as to keep an accurate cutting.

Further object of the present invention is to provide a platform minute adjustment, expansion and water collection device for a stone cutter which has a front expansion plate and a lateral expansion plate so as to enlarge the platform.

Accordingly, the platform minute adjustment, expansion and water collection devices for a stone cutter of the present invention comprises:

a water tank including front and rear ends supported by a pair of racks respectively, and one of the racks including one end connected to a water collection plate;

and a pair of guide rods, both of which are parallely arranged and perpendicularly connected to the tops of the racks, a platform having a plurality of rotors, each arranged on the lower side thereof for rotatably sliding such that the platform allows to move longitudinally;

a minute adjusting plate disposed on one of the racks and operated by a minute adjusting bolt for slightly moving the platform, and the guide rods and the water collection plate are provided to slide longitudinally;

thereby the water collection plate collects and leads the water and sawdust into the water tank and the platform moves longitudinally to align with the working pieces, enhancing cutting precision.

The present invention will become more fully understood by reference to the following detailed description thereof when read in conjunction with the attached drawings.

DETAILED DESCRIPTION OF THE PREFERRED EMBODIMENT

Figure 1:
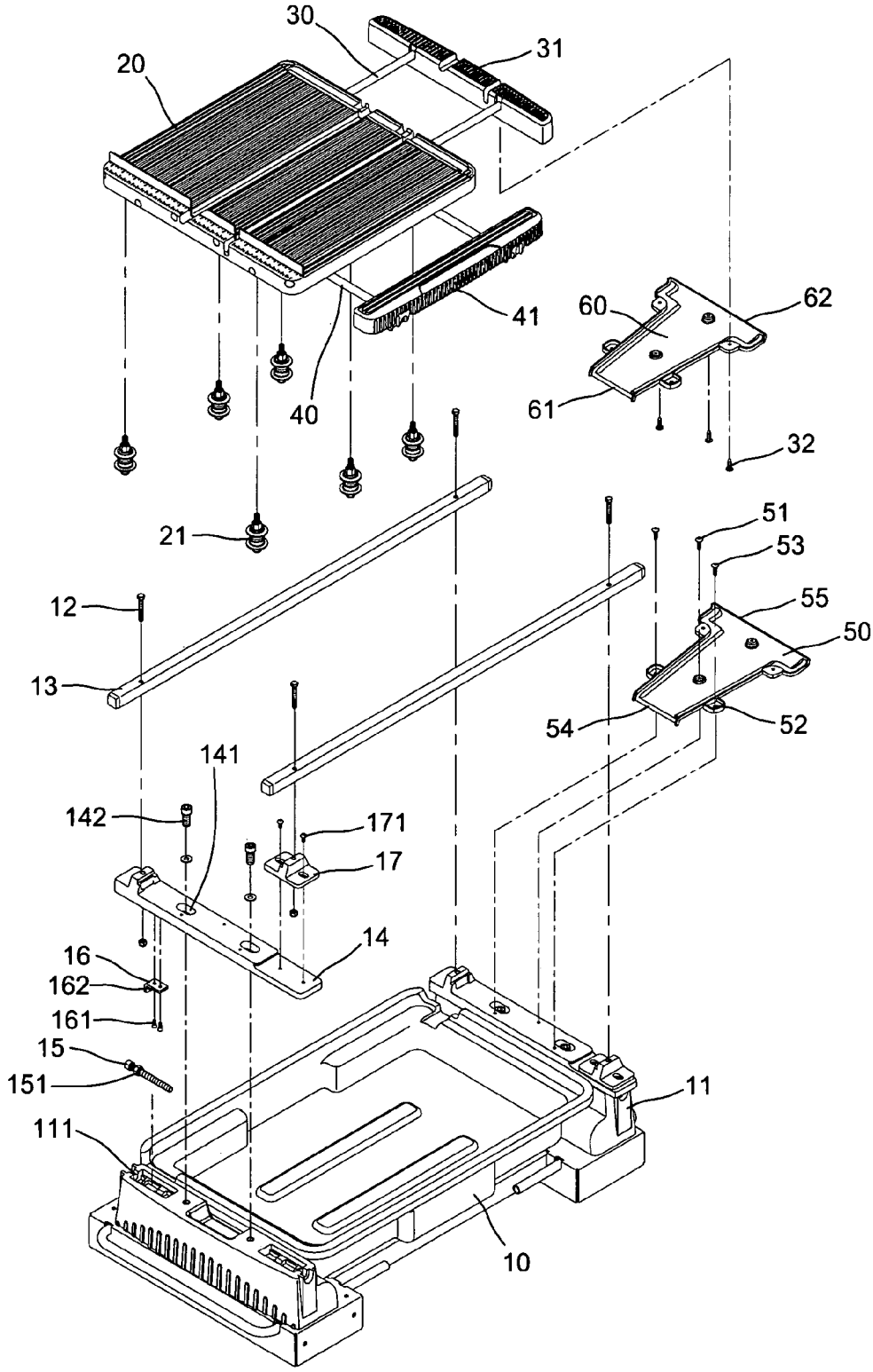
FIG. 1 is a perspective view showing the exploded components of a platform minute adjustment, expansion and water collection device for a stone cutter according to the preferred embodiment of the present invention.
Figure 2:
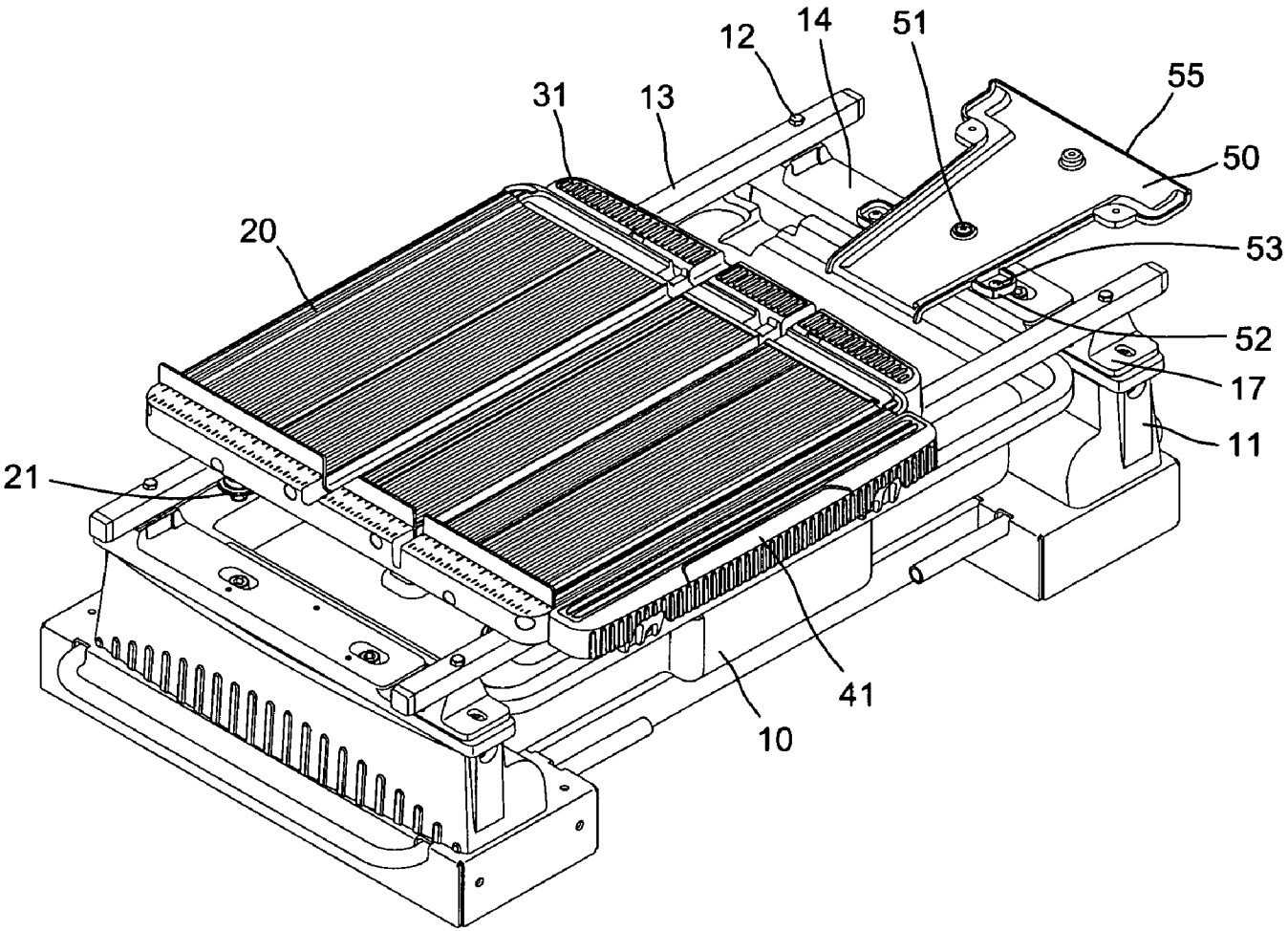
FIG. 2 is a perspective view showing the assembly of FIG. 1.

With reference to FIGS. 1 and 2, a platform minute adjustment, expansion and water collection devices for a stone cutter of the present invention comprises a water tank 10, a platform 20, a pair of first slidable rods 30, a pair of second slidable rods 40, a first water collection plate 50 and a second water collection plate 60.

The water tank has a rectangular body, a front end and a rear end supported by a pair of racks 11 respectively, a pair of the guide rods 13, both of which are parallely arranged and perpendicularly connected to the tops of the racks 11 by a plurality of bolts 12. One of the racks 11 slantly is connected with the first water collection plate 50 which has a positioning plate 52 fixed at the lower portion thereof and connected to the top of a minute adjusting plate 14 by using screws 53. The first water collection plate 50 has a lower end 54 bending downward and a hook-shaped upper end 55 bending upward. The front rack 11 has a stone cutter 70 provided at the lateral side thereof.

The platform 20 has a plurality of rotors 21 parallely arranged and slidably engaged with the inner sides of the guide rods 13 so as to displace the platform 20 horizontally, a pair of guide sleeves (not shown) horizontally disposed under the platform 20 for sliding the first slidable rods 30 therein, the outer ends of the slidable rods 30 are connected to an expansion plate 31 of the platform 20, the lower side of the expansion plate 31 is connected to the second water collection plate 60 by using screws 32, the second water collection plate 60 has a lower end 61 bending downward and an upper end 62 bending upward.

Figure 3:
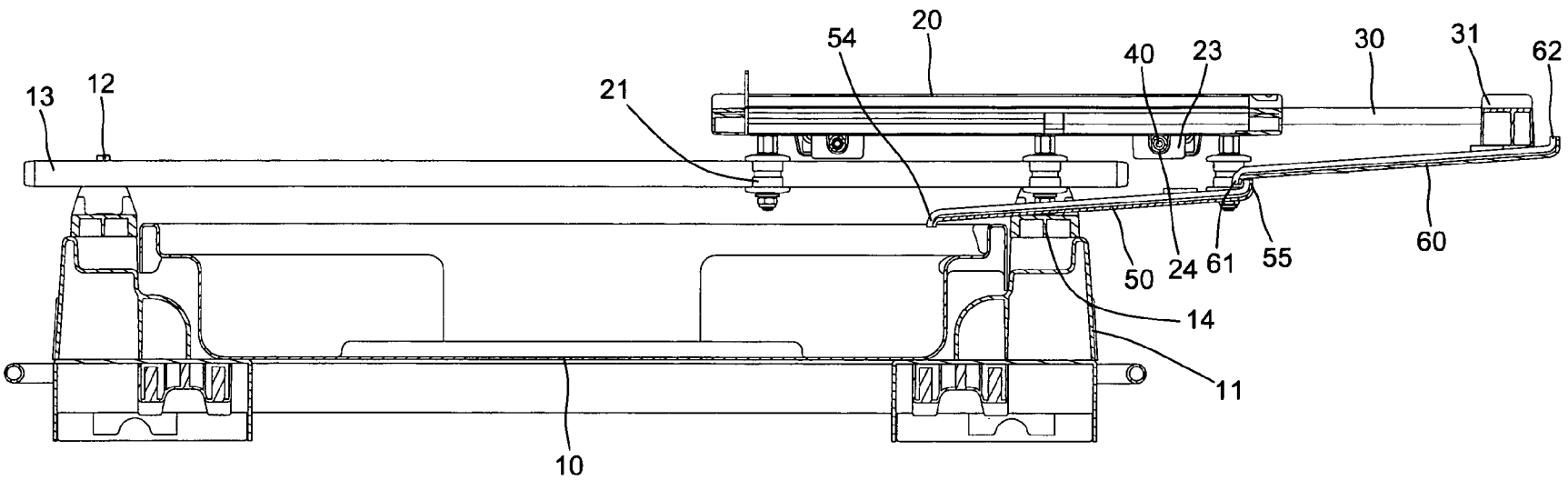
FIG. 3 is a plane view showing the platform being expanded and the water collection plate hooking the platform.

Referring to FIGS. 1 and 3, a pair of protruding rods 23 are parallely and longitudinally disposed under the platform 20, and each has a guide sleeve 24 at the center thereof for slidably disposing the second slidable rods 40, the outer ends of which are connected to a longitudinal expansion plate 41 of the platform 20.

On the top of each of the racks 11 is pivoted a minute adjusting plate 14 and each of the racks 11 has a retaining groove 111 which is provided to receive an adjustable bolt 15 in cooperation with a nut 151, the head of the bolt 15 is formed in the shape of a hexagon, the nut 151 is fixed in the retaining groove 111, the bolt 15 may only rotate without displacement, a positioning plate 16 has a screw hole 162 for permitting the bolt 15 to be swiveled therein and is secured to the minute adjusting plate 14 by a pair of screws 161, the minute adjusting plate 14 has a pair of oblong holes 141 for receiving a pair of bolts 142 which are screwed to the racks 11, the minute adjusting plate 14 further has a thin end to receive a butterfly plate 17 and is secured by a pair of screws 171, the plates 17 are in turn connected to the guide rods 13. When using a hexagon wrench to adjust the head of the bolt 15, it will urge the positioning plate 16, the minute adjusting plate 14, the guide rods 13 and the platform 20 to slightly displace longitudinally.

In operation, the sawdust and water vapor are directly captured by the first water collection plate 50 to prevent the water vapor as well as the sawdust from diffusing outside the stone cutter.

During cutting a working piece (as shown in FIG. 3), the user pulls the expansion plate 31 outwardly to expand the platform 20, and the second water collection plate 60 is simultaneously pulled outward and positioned under the sliding rod 30 and on the top of the first water collection plate 50, in the meantime, the lower end 61 of the second water collection plate 60 hooks the upper end 55 of the first water collection plate 50 so that the inner portion of the second water collection plate 60 overlaps with the outer portion of the first water collection plate 50. Thus the water vapor or sawdust flows to the first water collection plate 50 through the second water collect plate 60, and then the first water collection plate 50 flows the water vapor or sawdust to the water sink 10.

Figure 4:
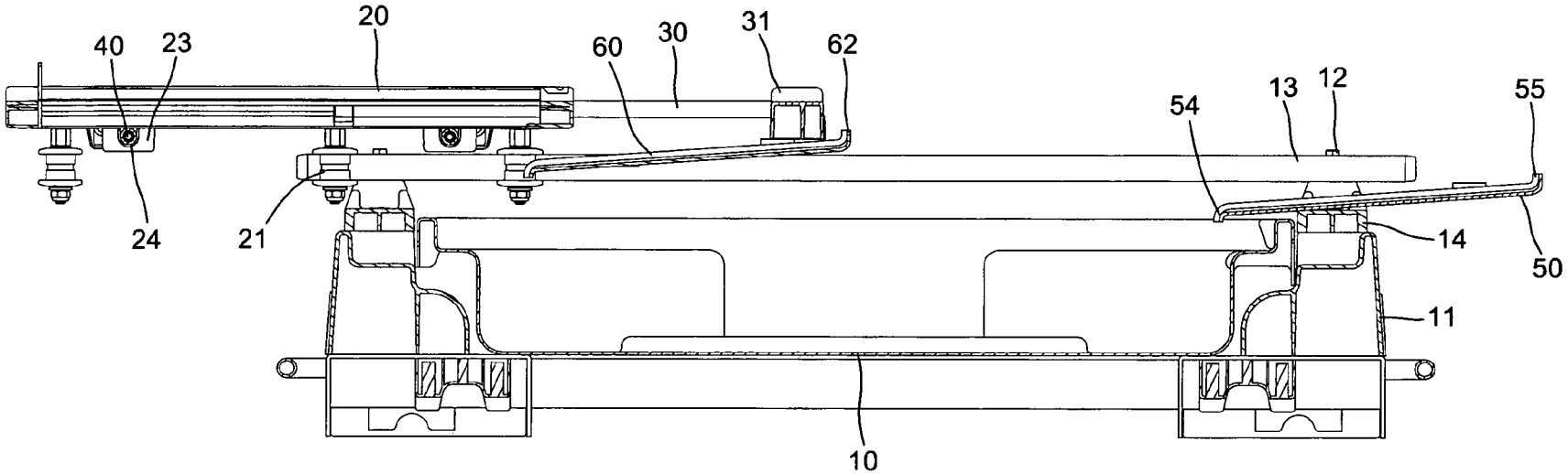
FIG. 4 is a plane view showing the platform being moving backward.

When pushing the expansion plate 31 back to the platform 20 (as shown in FIG. 4), the second water collection plate 60 moves out of the first water collection plate 50 with the platform 20.

Figure 5:
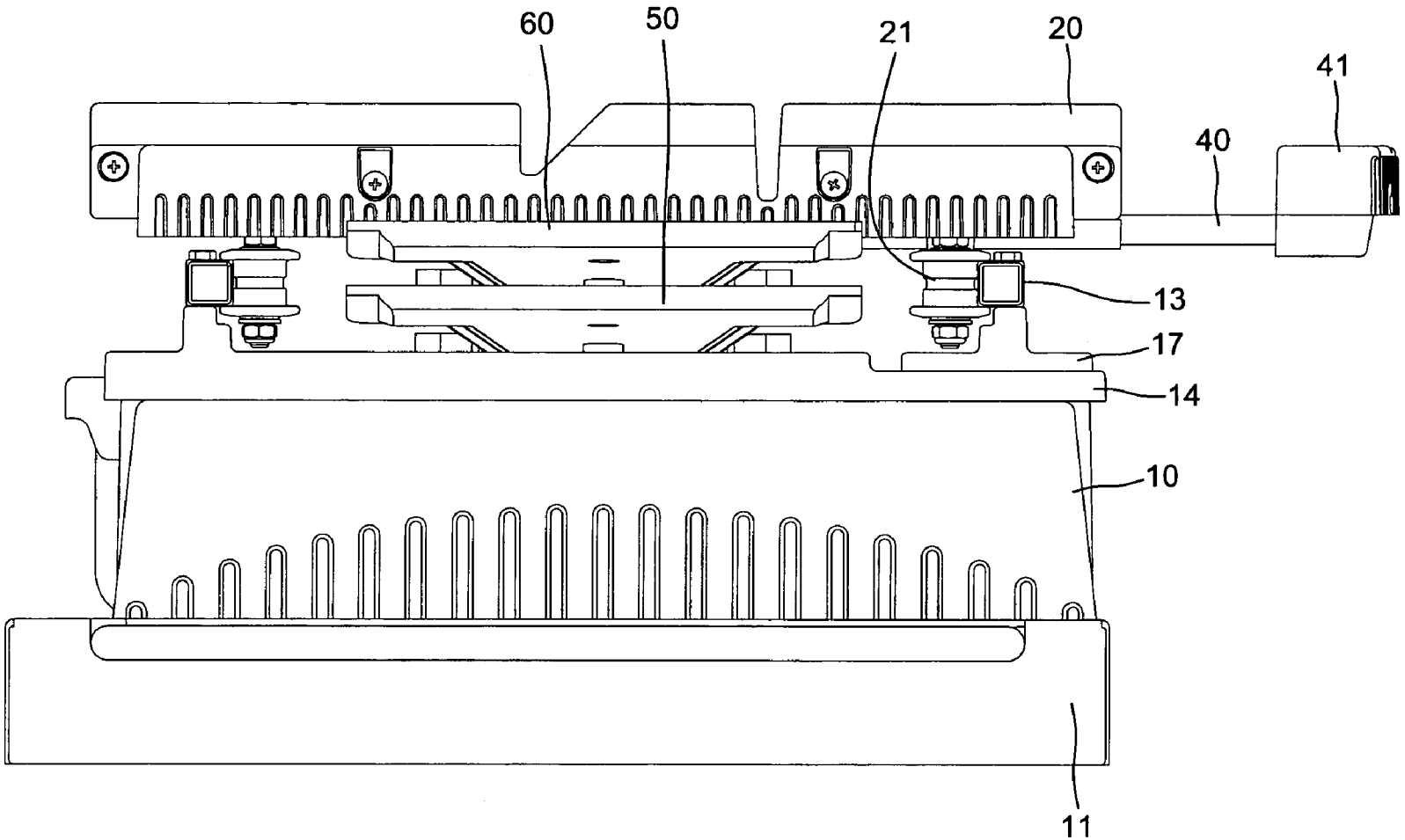
FIG. 5 is plane view showing the lateral expansion plate being stretching outward to enlarge the size of the platform.

Referring to FIG. 5, if the working piece is wider than the expansion plate 41, the user has to pull out the expansion plate 41 to match with the working pieces. This action will not hinder the first and second water collection plates 50 and 60, thereby positioning the stone cutter on the rack 11 properly.

Figure 6:
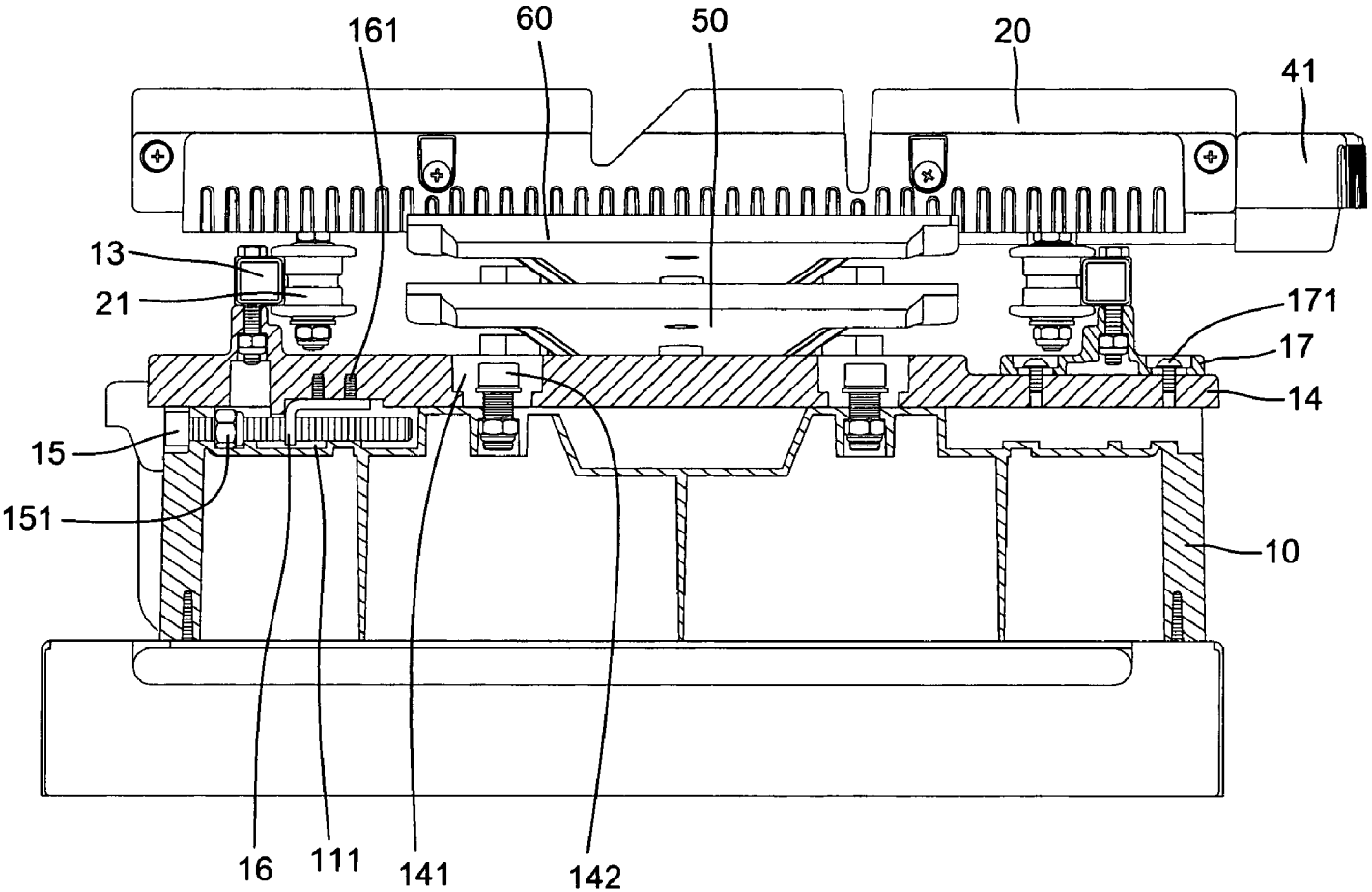
FIG. 6 is a cross sectional view showing the assembly of the platform minute adjustment, expansion and water collection device for a stone cutter according to the preferred embodiment of the present invention.
Figure 7:
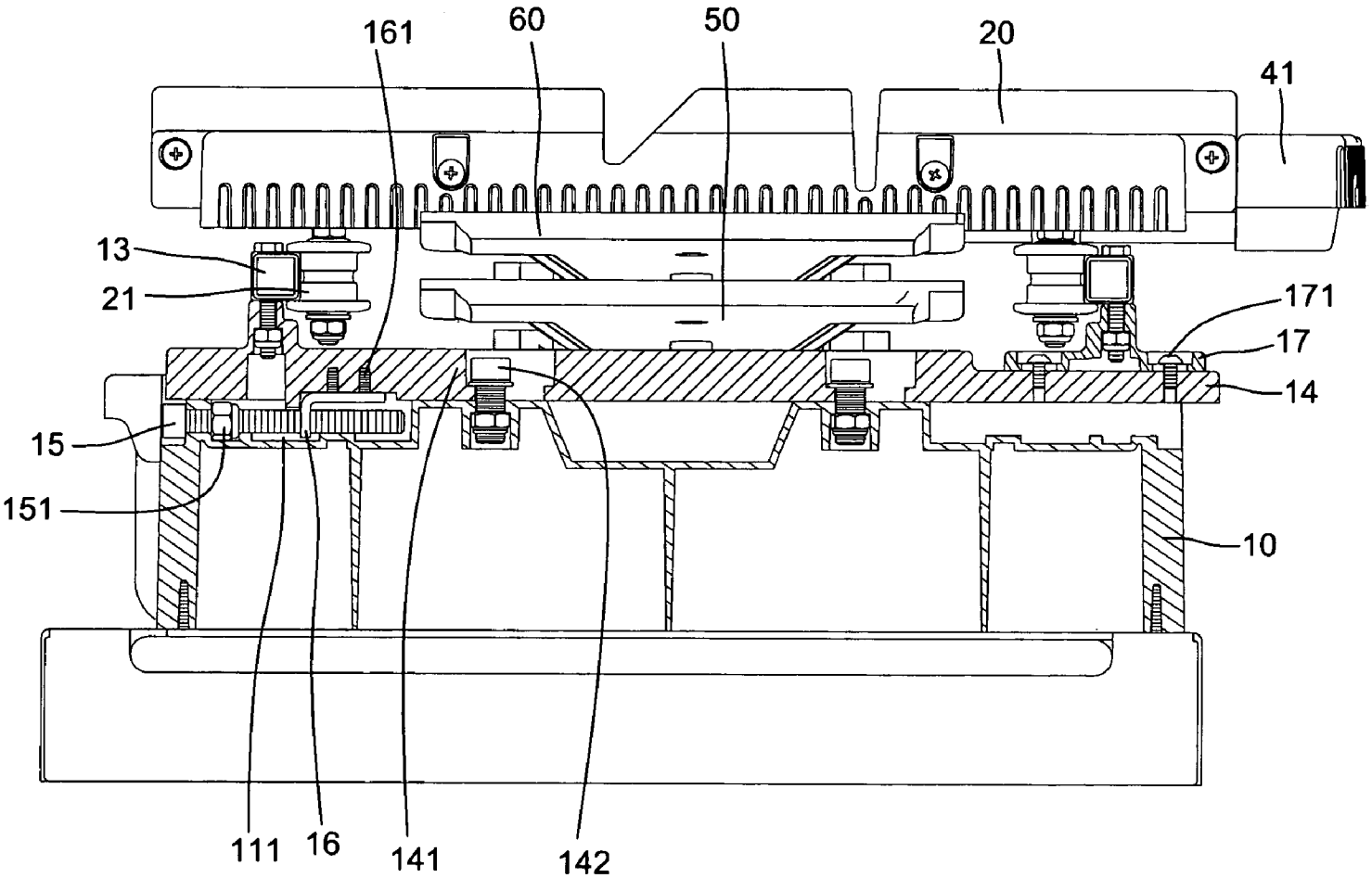
FIG. 7 is a cross sectional view showing the platform is slightly displacing under a minute adjustment.
Figure 8:
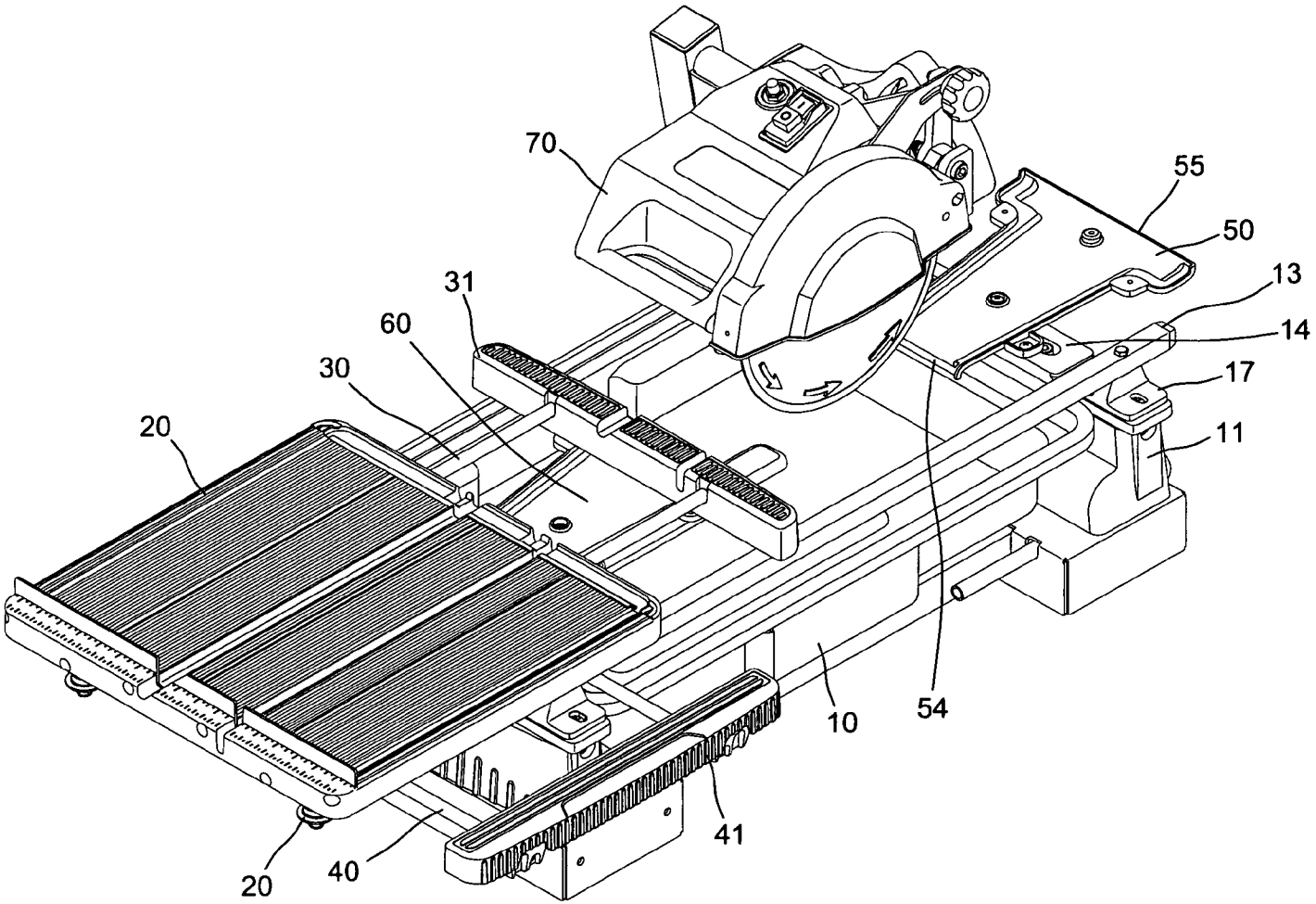
FIG. 8 is another perspective view showing the assembly of the platform minute adjustment, expansion and water collection device for the stone cutter according to the preferred embodiment of the present invention.

Referring FIGS. 6 and 7, when adjusting the platform 20, the head of the adjusting screw 15 is adjusted to push the positioning plate 16, and the positioning plate drive the minute adjusting plate 14 to accurate the guide rods 13, meanwhile the first water collection plate 50 performs a longitudinal minute adjustment together with the platform 20 (the platform 20 moves with the second water collection plate 60), so as to move the working piece, thus enhancing the cutting precision.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. A platform minute adjustment, expansion and water collection device for a stone cutter comprising:

a water tank having a rectangular body, a front end and a rear end respectively supported by a pair of racks, a pair of guide rods, both of which are parallely arranged and perpendicularly connected to the tops of the racks by a plurality of bolts, one of the racks slantly being connected with a first water collection plate which has a positioning plate fixed at the lower portion thereof and connected to the top of a minute adjusting plate by using screws, wherein the first water collection plate has a lower end bending downward and a hook-shaped upper end bending upward, the front rack has a stone cutter provided at the lateral side thereof;

a platform having a plurality of rotors parallely arranged and slidably engaged with the inner sides of the guide rods so as to displace the platform horizontally, a pair of guide sleeves horizontally disposed under the platform for sliding a pair of first slidable rods therein, the outer ends of the slidable rods being connected to an expansion plate of the platform, the lower side of the expansion plate being connected to the second water collection plate by using screws, the second water collection plate having an upper end bending upward and a lower end bending downward; a pair of protruding rods parallely and longitudinally disposed under the platform, and each having a guide sleeve at the center thereof for slidably disposing a pair of second slidable rods, the outer ends of which are connected to a longitudinal expansion plate of the platform;

a minute adjusting plate pivoted on the top of each of the racks, and each of the racks having a retaining groove which is provided to receive an adjustable bolt in cooperation with a nut, the head of the adjustable bolt being formed in the shape of a hexagon, the nut being disposed in the retaining groove, the adjustable bolt may only rotate without displacement, a positioning plate also disposed in the retaining groove and having a screw hole for permitting the bolt to be swiveled therein, the adjusting plate having oblong holes for receiving a pair of bolts which are screwed to the racks, further, the minute adjusting plates each having a thin end for receiving a butterfly plate secured by screws, the butterfly plate being in turn connected to the guide rods.

* * * * *